United States Patent [19]

Morgan, Jr.

[11] Patent Number: 4,744,481

[45] Date of Patent: May 17, 1988

[54] CLOSURE FOR CONTAINERS

[75] Inventor: Robert L. Morgan, Jr., Cockeysville, Md.

[73] Assignee: Poly-Seal Corporation, Baltimore, Md.

[21] Appl. No.: 46,394

[22] Filed: Apr. 6, 1987

[51] Int. Cl.[4] ..... B65D 53/00

[52] U.S. Cl. ..... 215/329; 215/341

[58] Field of Search ..... 215/341, 349, 350, 351, 215/329

[56] References Cited

U.S. PATENT DOCUMENTS

| | | | |
|---|---|---|---|
| 2,068,389 | 1/1937 | Smith | 215/350 |
| 2,734,651 | 2/1956 | Lindstrom | 215/329 |
| 2,980,276 | 4/1961 | Robineau | 215/260 |
| 4,381,840 | 5/1983 | Ostrowsky | 215/350 |

*Primary Examiner*—Donald F. Norton

*Attorney, Agent, or Firm*—Leonard Bloom

[57] ABSTRACT

A sealing closure for a container, such as bottles, jars and the like includes a threaded cap and a single-piece gasket of resilient material. The interior surface of the top of the threaded cap is provided with a plurality of radially extending ribs in the vicinity of its periphery. The peripheral portion of the single-piece gasket contacts the ribs, the cap being positionable over the rim of the neck of a container and in threaded engagement therewith to seal the container. The gasket may be of frusto-conical shape with a longitudinal sleeve thereon, the sleeve fitting over a central stud which is integral with the cap. The stud may be so dimensioned and shaped in cross-section, and the sleeve similarly shaped and dimensioned to prevent relative turning of the cap and gasket with respect to one another during opening and closing of a container with the closure.

7 Claims, 4 Drawing Sheets

CLOSURE FOR CONTAINERS

BACKGROUND OF THE INVENTION

This invention relates to closures for containers, such as bottles, jars and similar screw-top containers. More particularly, the present invention is concerned with a form of reusable closure which includes a sealing member for sealing such containers against leakage of fluid from the container and against contamination by materials from outside of the container.

A container closure, which includes a threaded cap and a single piece gasket, is known from U.S. Pat. No. 2,980,276 entitled "Bottle Closure" and granted to Doria Nina Robineau on Apr. 18, 1961. The known closure includes an internal, centrally located stud of circular cross-section extending downwardly from the major, smooth, flat, interior surface defining the top of the cap. The gasket is made of resilient material, is of generally frusto-conical shape and has a central longitudinal sleeve which fits over the stud. The peripheral end of the gasket, when in place, is pressed against the smooth, flat interior surface of the cap, the center sleeve having been placed on the cap by slipping the sleeve on the stud. The gasket can thus be centered on the neck of the container and its peripherial end portion pressed between the rim surface of the container and the smooth, flat, interior surface of the cap. During opening and closing of the container, the gasket tends to turn or twist with respect to the cap, distinct shortcomings. This tendency of the gasket to turn or twist not only affects the sealing characteristics of the closure, but also results in wearing out of and distortion to the sealing portion of the gasket itself.

A closure for sealing a bottle or container which is similar to the container closure disclosed in the patent to Robineau, supra, is known from U.S. Pat. No. 3,462,034 entitled "Means for Closing and Sealing a Bottle or Container" issued to Arthur A. Friedberg on Aug. 19, 1969. The gasket in this instance is substantially flat with a centrally located, downwardly directed plug which, when the gasket and its associated cap are positioned over the neck of a container, extends into an opening of reduced diameter to seal the neck portion of the container from the body portion. The gasket tends to turn with respect to the cap during the opening and the closing of the container, in essence a disadvantage not unlike the shortcomings associated with closures of the type disclosed in the patent to Robineau, supra.

A proposed solution to the above-noted disadvantage of having the gasket or sealing member turn with respective to the cap or having the gasket twist during the opening and closing of a container, is to provide a cap (shell) and sealing member (fitment) as a unitary piece, the cap and sealing member being permanently fixed to one another. An example of this type of construction is disclosed in U.S. Pat. No. 4,489,844 entitled "Screw-Type All Plastic Closure" granted to Charles A. Breskin on Dec. 25, 1984. This known closure consists of a cap and gasket constructed of different plastic materials which are injection molded in different portions of the same molding cavity. The gasket or fitment is first formed and, thereafter, without moving the fitment, the cap or shell is formed to produce a unitary structure. While avoiding the shortcoming and disadvantage of relative turning between the cap and sealing member or twisting of the gasket, it is clear that the cap and gasket cannot be separated; consequently, when one of these elements becomes defective or wears out, both must be replaced, a disadvantage.

As representative of the general background in the closure arts involving screw-type caps or shells combined with gaskets or fitments, are six (6) U.S. Letters Patents identified as follows:

| U.S. Pat. Nos. | Inventor(s) | Granting Dates |
|---|---|---|
| 2,917,198 | Beall, Jr. | 12/15/59, |
| 3,053,407 | Lowen | 09/11/62, |
| 3,129,809 | Annen | 04/21/64, |
| 3,940,005 | Granot | 02/24/76, |
| 4,394,923 | Sugiyama | 07/26/83, and |
| 4,405,054 | Braun et al. | 09/20/83. |

The closures for containers disclosed in the six (6) above-tabulated patents are similar, in relevant aspects, to those disclosed in the patents to Robineau, supra, and to Friedberg, supra, and can be characterized as having the disadvantage of having an insert or gasket which tends to turn or twist with respect to its associated screw-type cap during the opening and/or the closing of the container.

SUMMARY OF THE INVENTION

An object of the present invention is to provide a closure for a container which includes a cap and a sealing member and allows application of high removal torque without resulting in turning of the a sealing member relative to the cap.

Another object of the present invention is to provide a closure for a container which includes a cap and a sealing member which reduces the tendency of the sealing member to turn relative to the cap during opening or closing of a container.

An additional object of the present invention is to provide a closure for a container which includes a cap and a sealing member which may be readily separated from one another but allows application of relatively high torque during the opening and the closing of the container without resulting in turning of the sealing member relative to the cap.

A further object of the present invention is to provide a closure for a container which includes a cap and a sealing member and allows the application of high removal torque without resulting in twisting of the sealing member relative to the cap.

Yet another object of the present invention is to provide a closure for a container which includes a cap and a sealing member which reduces or eliminates the tendency of the sealing member to turn or twist relative to the cap during opening or closing of a container.

Yet an additional object of the present invention is to provide a closure for a container which includes a cap and a sealing member which may be readily separated from one another but allows application of relatively high torque during opening and closing of the container without resulting in turning or twisting of the sealing member relative to the cap.

The invention can be seen from one viewpoint as being a closure for a container having a mouth defined by a container wall portion encircling the mouth. The closure includes a cap having an open ended cylindrical portion with threads thereon for tightening same upon a container provided with complementing threads. A top portion of the cap is provided with an interior surface closing one end of same. A plurality of protuberances extend from the interior surface in vicinity of intersection between the interior surface and the cylindrical portion. A sealing member of resilient material fits within the cylindrical portion of the cap with a peripherial portion thereof adjacent to its circumference positioned over the plurality of protuberances extending from the interior surface of said cap to prevent turning of the cap relative to the sealing member during opening or closing of a container. The sealing member, when in use, fits sealingly over a mouth of a container with the peripherial portion of the sealing member over an end of a wall portion of a container encircling a mouth thereof.

The invention can be viewed as a closure for a container having a mouth defined by a container wall portion encircling the mouth, the closure including a cap and a sealing member. The cap has an open ended cylindrical portion with threads thereon for tightening same upon a container having complementing threads thereon. A top portion of the cap is provided with an interior surface closing one end of same and a plurality of ribs extending from the interior surface in vicinity of intersection between the interior surface and the cylindrical portion. A sealing member of resilient material is fitted within the cylindrical portion of the cap with a peripherial portion thereof adjacent to its circumference positioned over the plurality of ribs extending from the interior surface of the cap to prevent turning of the cap relative to the sealing member during opening or closing of a container so that the sealing member may be sealingly fit over a mouth of a container with the peripherial portion of the sealing member over an end of a wall portion of a container encircling a mouth thereof. The closure can be removed from and be placed on a container by application of high torque without the sealing member turning relative to the cap.

In one preferred embodiment, the invention can be seen as a closure for a container having a mouth defined by a container wall portion encircling the mouth, the closure including a cap of special construction and a sealing member. The cap has an open ended cylindrical portion with threads thereon for tightening same upon a container provided with a neck having complementing threads. A top portion of the cap is provided with an interior surface closing one end of same. A plurality of radially extending ribs are provided on the interior surface in vicinity of intersection between the interior surface and the cylindrical portion. The radially extending ribs are substantially equally angularly spaced from adjacent ones thereof. A sealing member of resilient material is fitted within the cylindrical portion of the cap with a peripherial portion thereof adjacent to its circumference positioned over the plurality of ribs extending from the interior surface of the cap to prevent turning of the cap relative to the sealing member during opening of a container so that the sealing member may be sealingly fit over a mouth of a container with the peripherial portion of the sealing member over an end of a wall portion of a container encircling a mouth thereof. The closure can be removed from and placed on a container by application of high torques without the sealing member turning relative to the cap.

The sealing member in one preferred embodiment is a substantially flat single piece gasket.

The sealing member is of frusto-conical shape and flares outwardly from a central portion thereof in two preferred embodiments.

The sealing member may be provided with an internal stud of substantially circular cross-section, the sealing member being of substantially frusto-conical shape. A central, substantially cylindrical, longitudinally extending sleeve is provided. The stud is fitted within the sleeve.

The cap may be provided with an internal stud of noncircular cross-section. The sealing member in this case may be of substantially frusto-conical shape and has a central, longitudinally extending sleeve having a noncircular cross-section corresponding to the cross-section of the stud. The stud is fitted within this sleeve.

The cap may be provided with an internal stud of substantially circular cross-section. The sealing member in this case has a central, substantially cylindrical longitudinally extending sleeve. The stud is fitted within this sleeve.

The cap may be provided with an internal stud of noncircular cross-section. The sealing member, in this case, has a central longitudinally extending sleeve having a noncircular cross-section corresponding to the cross-section of the stud. The stud is fitted within the sleeve.

From a different vantage point, the invention can be seen as being in a closure for a container having a mouth defined by a wall portion terminating in an end encircling the mouth and which includes a cap having a cylindrical portion on the cap. Threads for tightening the closure upon a container are provided. A top portion of the cap closes one end of the cap. A sealing member having a peripherial portion is positioned within the cap. A plurality of protuberances, which may be radial ribs, extend from a peripherial portion of the interior surface of the top portion of the cap in vicinity of intersection between the interior surface of the top portion and the cylindrical portion. The peripherial portion of the sealing member is positioned against the protuberances so that, when in a sealing relationship on an end of a container, the peripherial portion of the sealing member is forced against the protuberances whereby high torques may be applied to the cap without resulting in turning of said sealing member with respect to said cap during the sealing and unsealing of a container with the closure.

The invention can also be seen as being in a closure for a container having a mouth defined by a wall portion terminating in an end encircling the mouth and which includes a cap having a cylindrical portion on the cap. Threads are provided on the cap for tightening the same upon a container. The cap includes a top portion, enclosing one end of the cap and having an interior surface. A sealing member is provided. A noncircular stud extends from the interior surface of the top portion. A central, noncircular longitudinally extending sleeve forms part of the sealing member. The stud is fitted over the sleeve whereby the sealing member and said cap are prevented from substantial turning during application of high torques during opening and closing of a container.

DETAILED DESCRIPTION OF THE PREFERRED EMBODIMENTS

Figure 1A:
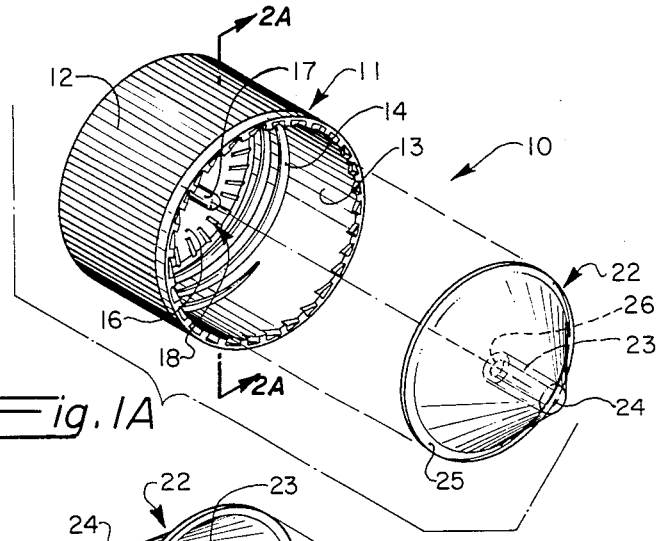
FIG. 1A is a pictorial view of a first exemplary embodiment of a closure for containers, the cap and the sealing member thereof being shown in exploded relationship to expose details of the interior of the cap.
Figure 1B:
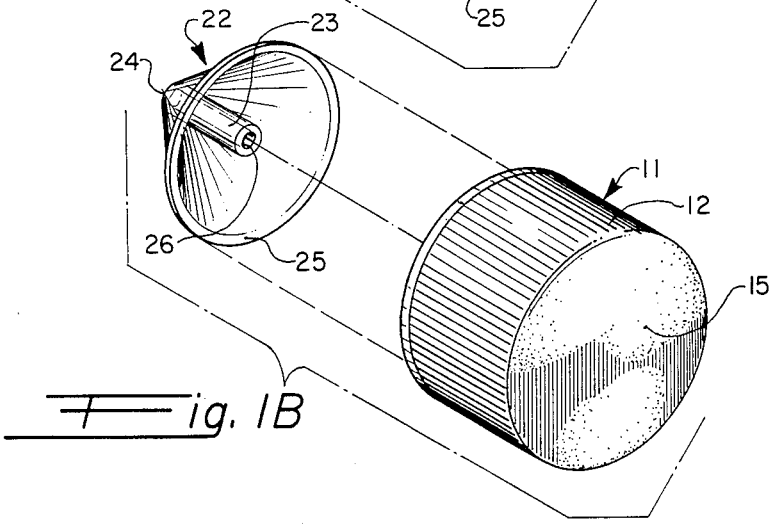
FIG. 1B is a pictorial view of the first embodiment of the closure illustrated in FIG. 1A from a reverse viewpoint, the cap and the sealing member thereof being shown in exploded relationship to expose details of the interior of the sealing member.

As illustrated in FIGS. 1A and 1B, the first embodiment of a closure 10 for containers, such as bottles, jars and similar so-called screw-top containers includes a cap 11 having an axial cylindrical portion provided with a conventional, knurled cylindrical outer surface 12 and a cylindrical inner surface 13 having conventional threads 14 thereon. The threads 14 are to be engaged with complementing threads on the top or neck of a container of conventional design. The cap 11 may be formed of a hard plastic or an other material of suitable mechanical strength for forming a closure for a container. The cap 11, as illustrated includes a top portion defined by an exterior, substantially flat surface 15 and an interior, substantially flat surface 16.

Figure 7:
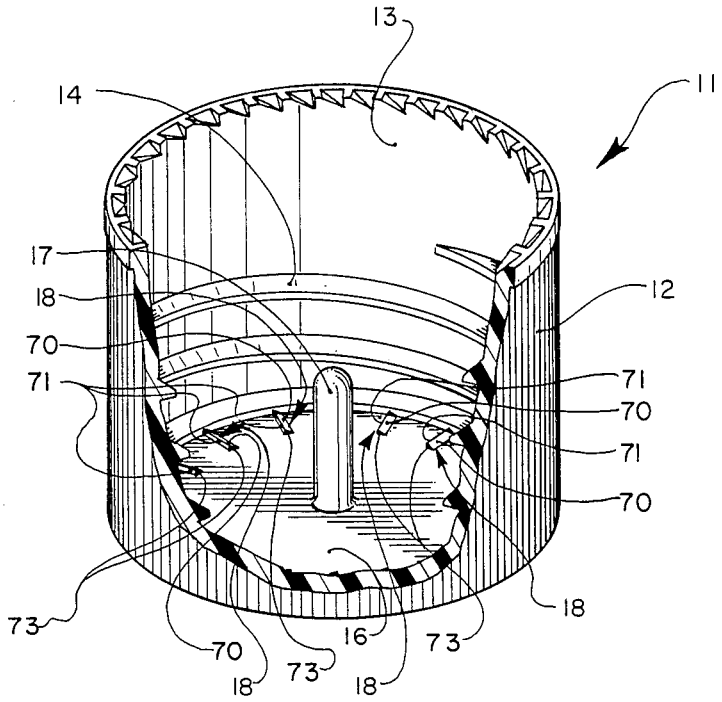
FIG. 7 is an enlarged pictorial view of the cap portion of the closures of the present invention, partially broken away to show details of ribs extending from the top portion of the cap.

Extending upwardly from the surface 16 from the center thereof is an internal stud 17 of generally circular cross-section and which may be solid or hollow. A plurality of radial ribs 18 extend from the interior flat surface 16 about the peripherial portion thereof. As best seen in FIG. 1A, the ribs 18 extend radially from the intersection between the interior, cylindrical surface 13 and along the interior, flat surface 16 toward the central portion thereof, the longitudinal extent of the ribs 18 is preferably at least as long as the width of the rim of a container which is to be sealed by the closure 10. Each of the ribs 18, as best seen in FIG. 7, is of wedge-shape terminating in a respectively triangularly shaped ends 73, the lateral extent of each of the ribs being defined by a respective flat, inclined surface 70 and a respective axially extending, flat surface 71, the axially extending surfaces 71 being positioned, with respect to the rotational direction of containing-opening movements, on the downstream side. It is to be appreciated that the ribs 18 could be of different configurations, albeit the wedge-shape configuration and annular distribution as shown in FIG. 7 are particularly effective and are preferred.

The closure 10 illustrated in FIGS. 1A and 1B includes a liner, fitment or single-piece gasket hereinafter referred to as a sealing member 22 of resilient material, generally of frustoconical shape and having a central cylindrical longitudinally extending sleeve 23 which defines a bore 26 and is closed at its lower end by an integral web 24. The conical, outer surface extended at about an angle of 45° to a circumferential intersection which corresponds substantially to the neck or rim of a bottle, jar or the like, whereupon the circumferential portion of the sealing member when depressed between the cap 11 and the rim of the neck of a container to be closed is bent outwardly substantially in a plane transverse to the axis of the central, cylindrical sleeve 23 to form a circumferential flange 25 of the sealing member 22. The flange 25 may be preformed, if desired, and thus visible even before the sealing member 22 has been distorted in the course of sealing of a container or it may be formed in the course of sealing a container by distorting the end portion of the member.

The outer diameter of the stud 17 and the inner diameter of the bore 26 in the sleeve 23 are so dimensioned and shaped with respect to one another that the sealing member 22 can be readily fitted by application of force over the stud 17 so as to give accurate centering of the sealing member 22 within the cap 11.

Figure 2A:
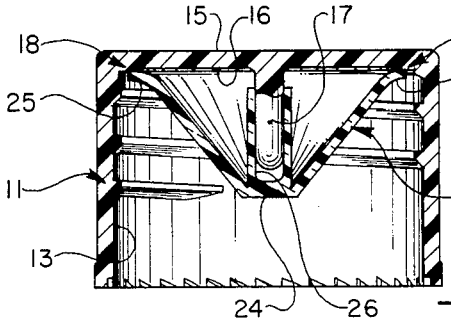
FIG. 2A is a sectional view of the first embodiment of the closure illustrated in FIG. 1A, the section having been taken along section line 2A—2A of FIG. 1A with the sealing member being positioned within the cap.
Figure 2B:
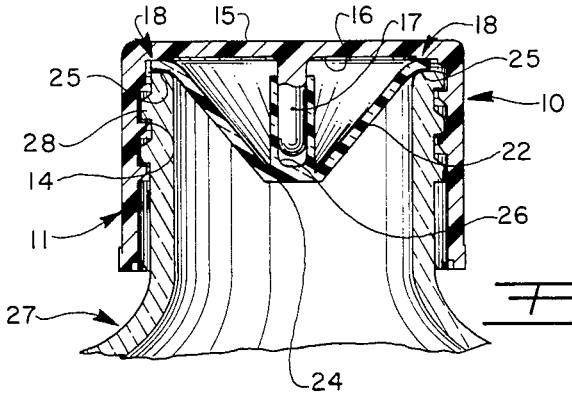
FIG. 2B is a sectional view of the first embodiment of the closure illustrated in FIG. 2A in combination with a glass container, shown as a fragment, the container being illustrated as having its neck sealed by the closure.

As shown in FIG. 2A, the closure 10 constructed in accordance with the first embodiment of the present invention, ready for use, has the sleeve 23 of the sealing member 22 positioned over the stud 17 with the peripherial area thereof which is to or does define the flange 25 in contact with the ribs 18. As illustrated in FIG. 2B, the closure 10 is positioned over a threaded neck of a glass bottle 27, shown as a fragment, with the threads 14 of the cap 11 engaged with threads 28 on the neck of the glass bottle. The flange 25 defined by the periphery of the sealing member 22 is positioned between the rim of the neck of the bottle 27 and the ribs 18 extending from the peripherial portion of the interior, flat surface 16 of the top 11. As so positioned, were one to rotate the closure 10 to seal or to unseal the bottle 27, considerably more torque can be applied without the sealing member 22 moving with respect to the cap 11, because of the engagement of the flange 25 of sealing member 22 with the shaped ribs 18 of the cap.

As illustrated in FIG. 7, the closure 10 is provided with the radially extending ribs 18 which are formed on the interior, flat surface 16 of the cap 11. During the sealing of a container, the cap 11 is rotated so as to bring the flange 25 (FIG. 2B) of the resilient sealing member 22 (FIG. 2B) into contact with the ribs 18 with the surface of the sealing member 22 (FIG. 2B) so that initial contact is made by the line of intersection between the surfaces 70 and 71. As a result of further rotation of the cap 11, the flange 25 of the resilient sealing member 22 bends slightly, distorts and the sealing member is prevented from turning, with respect to the cap 11 by virtue of its contact with the surfaces 71 of the ribs 18. Considerable container-closing torque can then be applied to assure good sealing and, because of the inclined surfaces 70 of the ribs 18, the container can be unsealed by application of torque which need not exceed the closing torque, but is still high, without the sealing member 22 turning with respect to the cap 11.

Figure 3A:
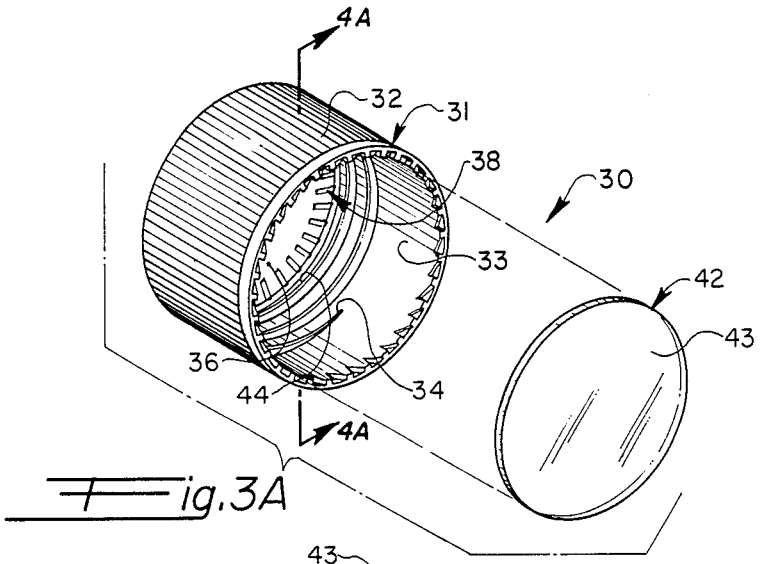
FIG. 3A is a pictorial view of a second exemplary embodiment of a closure for containers, the cap and the sealing member thereof being shown in exploded relationship to expose details of the interior of the cap.
Figure 3B:
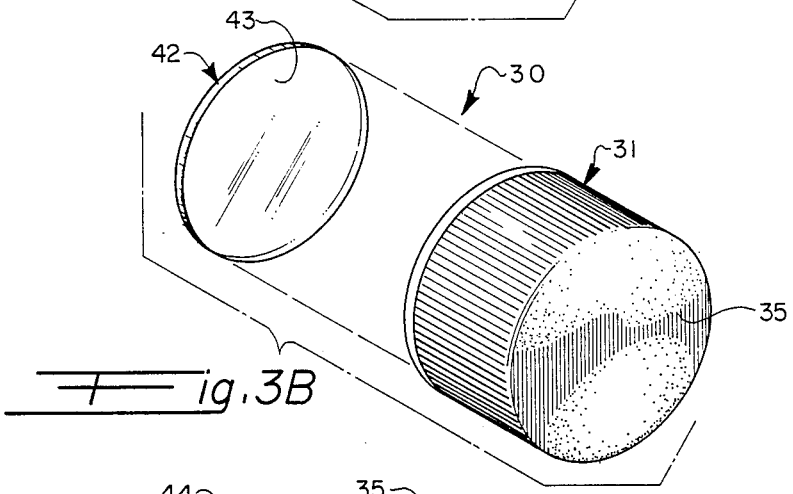
FIG. 3B is a pictorial view of the second embodiment of the closure illustrated in FIG. 3A from a reverse viewpoint, the cap and the gasket thereof being shown in exploded relationship to show the reverse major surface of the sealing member.

As illustrated in FIGS. 3A and 3B, the second embodiment of a closure 30 for containers, such as bottles, jars and similar so-called screw-top containers includes a cap 31 having an axial cylindrical portion provided with a conventional, knurled cylindrical outer surface 32 and a cylindrical inner surface 33 having conventional threads 34 thereon. The threads 34 are to be engaged with complementing threads on the top or neck of a container of conventional design. The cap 31 may be formed of a hard plastic or any other material of suitable mechanical strength for forming a closure for a container. The cap 31, as illustrated includes a top portion defined by an exterior, substantially flat surface 35 and an interior, substantially flat surface 36. A circumferential flange 44 extends inwardly from the cylindrical surface 33 of the cap 31 in close vicinity to and spaced from the flat surface 36 to receive and losely position a sealing member within the cap 31. A plurality of ribs 38 extend axially from the interior flat surface 36 about the peripherial portion thereof. As best seen in FIG. 3A, the ribs 38 extend radially from the intersection between the interior, cylindrical surface 33 and along the interior, flat surface 36 toward the central portion thereof, the longitudinal extent of the ribs 38 is preferably at least as long as the width of the rim of a container which is to be sealed by the closure 30. Each of the ribs 38 are preferably shaped and distributed as are the ribs 18 of the first embodiment (FIG. 1A). As best seen in FIG. 7, each of the ribs is of wedge-shape, the lateral extent of each of the ribs being defined by a respective inclined surface 70 and a respective axially extending surface 71, the axially extending surfaces 71 being positioned, with respect to the rotational direction of containing-opening movements, on the downstream side. It is to be appreciated that the ribs 38 could be of different configurations, albeit the wedge-shape configuration and even angular distribution, illustrated in FIG. 7, are particularly effective and are preferred.

The closure 30 illustrated in FIGS. 3A and 3B includes a liner, fitment or single-piece gasket, hereinafter referred to as a sealing member 42, made of resilient material and generally of flat, circular configuration. The circumferential portion 43 of the sealing member 42 when depressed between the cap 31 and the rim of the neck of a container to be sealed, becomes distorted in the same manner as the sealing member 22 (FIG. 2B) of the first embodiment, allowing application of high closing and opening torques to the cap 31 without causing the resilient sealing member 42 to turn with respect to the cap 31.

Figure 4A:
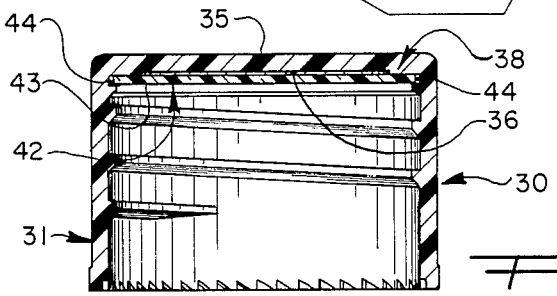
FIG. 4A is a sectional view of the second embodiment of the closure illustrated in FIG. 3A, the section having been taken along section line 4A—4A of FIG. 3A with the sealing member being fitted within the cap.
Figure 4B:
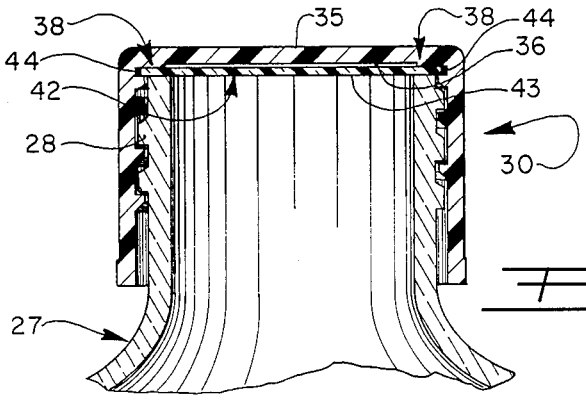
FIG. 4B is a sectional view of the second embodiment of the closure illustrated in FIG. 4A in combination with a glass container, shown as a fragment, the container being illustrated as having its neck sealed by the closure.

As shown in FIG. 4A, the closure 30 constructed in accordance with the second embodiment of the present invention, ready for use, has the flat, resilient sealing member 43 positioned behind the flange 44 of the cap 31 with the peripherial area of the circumferential portion 43 thereof in contact with the ribs 38. As illustrated in FIG. 4B, the cap 30 is positioned over the threaded neck of the glass bottle 27, shown as a fragment, with the threads 34 of the cap 31 engaged with the threads 28 on the neck of the glass bottle. The circumferential portion 43, defined by the periphery of the sealing member 42, is positioned between the rim of the neck of the bottle 27 and the ribs 38 extending from the peripherial portion of the interior, flat surface 36 of the cap 31. As so positioned, were one to rotate the cap 31 to seal or unseal the bottle 27, considerably more torque can be applied without the sealing member 42 moving with respect to the cap 31, because of the engagement of the peripherial portion 24 of sealing member 42 with the shaped ribs 38 of the cap.

Figure 5A:
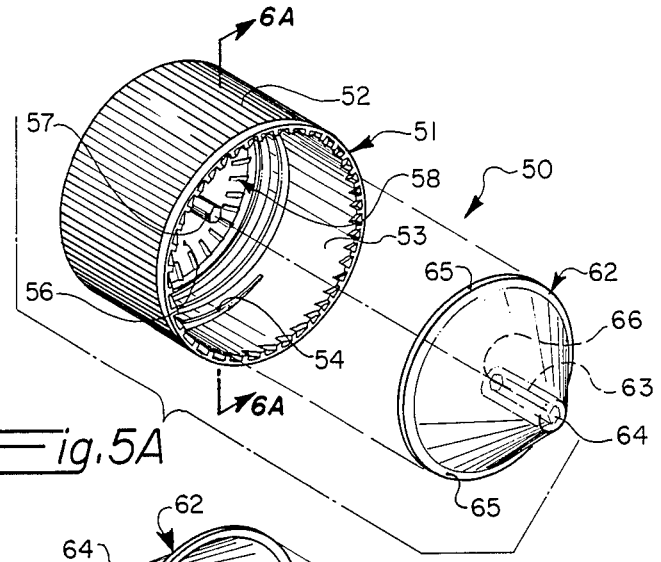
FIG. 5A is a pictorial view of a third exemplary embodiment of a closure for containers, the cap and the sealing member thereof being shown in exploded relationship to expose details of the interior of the cap.
Figure 5B:
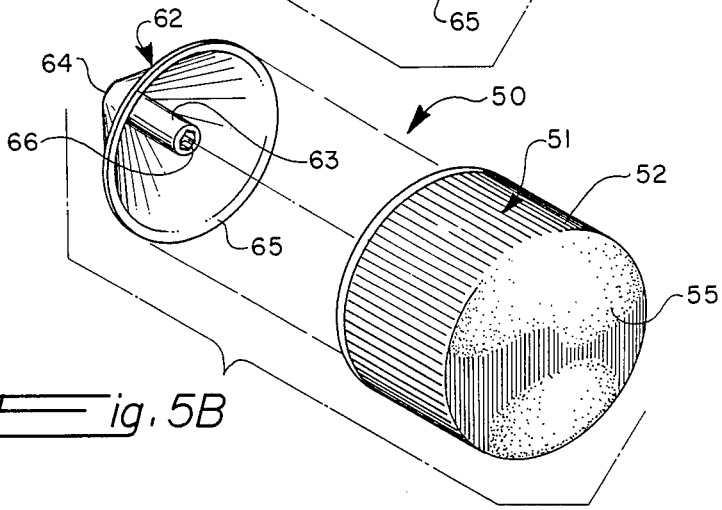
FIG. 5B is a pictorial view of the third embodiment of the closure illustrated in FIG. 5A from a reverse viewpoint, the cap and the sealing member thereof being shown in exploded relationship to expose details of the interior of the sealing member.

As illustrated in FIGS. 5A and 5B, the third embodiment of a closure 50 for containers, such as bottles, jars and similar so-called screw-top containers includes a cap 51 having an axial cylindrical portion provided with a conventional, knurled cylindrical outer surface 52 and a cylindrical inner surface 53 having conventional threads 54 thereon. The threads 54 are to be engaged with complementing threads on the top or neck of a container of conventional design. The cap 51 may be formed of a hard plastic or any other material of suitable mechanical strength for forming a closure for a container. The cap 51, as illustrated, includes a top portion defined by an exterior, substantially flat surface 55 and an interior, substantially flat surface 56.

Extending upwardly from the interior surface 56 from the center thereof is an internal stud 57 of noncircular cross-section and which may be solid or hollow. As illustrated, the internal stud 57 is shown as being hexagonal in cross-section. A plurality of ribs 58 extend axially from the interior flat surface 56 about the peripherial portion thereof. As best seen in FIG. 5A, the ribs 58 extend radially from the intersection between the interior, cylindrical surface 53 and along the interior, flat surface 56 toward the central portion thereof, the longitudinal extent of the ribs 58 is preferably at least as long as the rim of the container which is to be closed by the closure 50. Each of the ribs 58 are shaped and distributed as the ribs 18 in the first embodiment (FIG. 1A). As best seen in FIG. 7, the ribs 58 are preferably of wedge-shape, the lateral extent of each of the ribs being defined by a respective inclined surface corresponding to the included surfaces 70 (FIG. 7) and a respective axially extending surface corresponding to the surfaces 71 (FIG. 7), the axially extending surfaces 71 being positioned, with respect to the rotational direction of containing-opening movements, on the downstream side. It is to be appreciated that the ribs 58 could be of different configurations, albeit the wedge-shape configuration is particularly effective.

The closure 50 illustrated in FIGS. 5A and 5B includes a liner, fitment or single-piece gasket hereinafter referred to as a sealing member 62 of resilient material, generally of frusto-conical shape and having a central cylindrical longitudinally extending sleeve 63 which is closed at its lower end by an integral web 64. The conical, outer surface extended at about an angle of 45° to a circumferential intersection which corresponds substantially to the neck or rim of a bottle, jar or the like, whereupon the circumferential portion of the sealing member when depressed between the cap 51 and the container to be closed is bent outwardly substantially in a plane transverse to the axis of the central, cylindrical sleeve 63 to form a circumferential flange 65 of the sealing member 62. The flange 65 may be preformed, if desired, and thus visible even before the sealing member 62 has been distorted in the course of sealing of a container.

The stud 57 and a bore 66 in the sleeve 63 are so dimensioned and shaped with respect to one another that the sealing member 52 can be readily fitted over the stud 57 so as to give accurate centering of the sealing member 52 within the cap 51. The stud 57 and the bore 66 are of noncircular cross-section and are so dimensional that the stud 57 fits tightly within the bore 66. As illustrated, the bore 66 and the stud 57 are of hexagonal cross-sectional shape so that the sealing member 62 is held against rotation with respect to the cap 51.

Figure 6A:
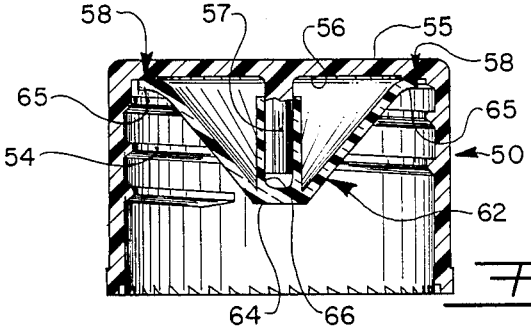
FIG. 6A is a sectional view of the third embodiment of the closure illustrated in FIG. 5A, the section having been taken along section line 6A—6A of FIG. 5A with the sealing member being positioned within the cap.
Figure 6B:
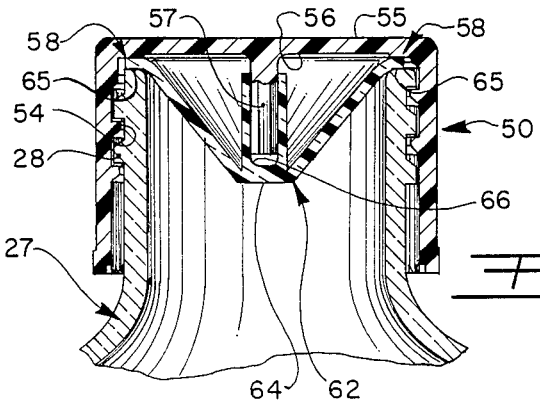
FIG. 6B is a sectional view of the third embodiment of the closure illustrated in FIG. 6A in combination with a glass container, shown as a fragment, the container being illustrated as having its neck closed by the closure.

As shown in FIG. 6A, the closure 50 constructed in accordance with the third embodiment of the present invention, ready for use, has the sealing member 62 positioned over the stud 57 with the peripherial area thereof which is to or does define the flange 65 in contact with the ribs 58. As illustrated in FIG. 5B, the cap 50 is positioned over a threaded neck of a glass bottle 27, shown as a fragment, with the threads 54 of the cap 51 engaged with complementing threads 28 on the neck of the glass bottle. The flange 65 defined by the periphery of the sealing member 52 is positioned between the rim of the neck of the bottle 27 and the ribs 58 extending from the peripherial portion of the interior, flat surface 56 of the top 51. As so positioned, were one to rotate the cap 50 to seal or to unseal the bottle 27, considerably more torque can be applied without the sealing member moving (turning or twisting) with respect to the cap 51, because of the engagement of the flange 65 of the sealing member 62 with the shaped ribs 58 of the cap and because of action of the noncircular stud 57 and the noncircular complementing bore 66 of noncircular cross-sections.

It is to be understood that the foregoing description of the preferred embodiments of the closures for containers and the accompanying illustrations thereof have been set out by way of example, not by way of limitation. Numerous other embodiments and variants of containers are possible without departing from the spirit and scope of the invention, its scope being defined in the appended claims.

What is claimed is:

1. A closure for a container having a mouth defined by a container wall portion encircling the mouth, the closure comprising, in combination:

a cap having an open ended cylindrical portion with means thereon for tightening the cap upon a container, an aperture free top portion provided with an interior circular surface having four quadrants and closing one end of the cap, respective pluralities of protuberances extending from the interior surface in each of the quadrants in vicinity of intersection between the interior surface and the cylindrical portion and an internal stud of substantially circular cross section extending from the interior surface and located centrally thereon; and a sealing member of resilient material and having a circumference, said sealing member being fitted within said cylindrical portion of said cap with a peripherial portion thereof adjacent to said circumference of the sealing member positioned over said respective pluralities of protuberances extending from said interior surface of said cap to prevent turning of the cap relative to the sealing member during closing and opening of a container so that the sealing member may be sealingly fit over a mouth of a container with said peripherial portion of the sealing member over an end of a wall portion of a container encircling a mouth thereof; and wherein said sealing member is of substantially frustoconical shape flairs outwardly from a central portion thereof and has a central, substantially cylindrical, longitudinally extending sleeve, said stud being fitted within said sleeve;

whereby the closure can be placed on and removed from a container by application of high removal torques without the sealing member turning relative to the cap.

2. A closure for a container having a mouth defined by a container wall portion encircling the mouth, the closure comprising, in combination:

a cap having an open ended cylindrical portion with means thereon for tightening the cap upon a container, an aperture-free top portion provided with an interior circular surface having four quadrants and closing one end of the cap and respective pluralities of protuberances extending from the interior surface in each of the quadrants in vicinity of intersection between the interior surface and the cylindrical portion and an internal stud substantially non-circular cross-section extending from the interior surface and centrally located thereon; and a sealing member of resilient material and having a circumference, said sealing member being fitted within said cylindrical portion of said cap with a peripherial portion thereof adjacent to said circumference of the sealing member positioned over said pluralities of protuberances extending from said interior surface of said cap to prevent turning of the cap relative to the sealing member during closing and opening of a container so that the sealing member may be sealingly fit over a mouth of a container with said peripherial portion of the sealing member over an end of a wall portion of a container encircling a mouth thereof; and wherein said sealing member is of substantially frustoconicals shape, flairs outwardly from a central portion thereof and has a central, longitudinally extending sleeve having a noncircular cross-section corresponding to the cross-section of the stud, said stud being fitted within said sleeve;

whereby the closure can be placed on and removed from a container by application of high removal torques without the sealing member turning relative to the cap.

3. A closure for a container having a mouth defined by a container wall portion encircling the mouth, the closure comprising in combination:

a cap having an open ended cylindrical portion with means thereon for tightening the cap upon a container, an aperture-free top portion provided with an interior circular surface having four quadrants and closing one end of the cap, respective pluralities of ribs extending from the interior surface in each of the quadrants in vicinity of intersection between the interior surface and the cylindrical portion and an internal stud of substantially circular cross-section extending from the interior surface and centrally located thereon; and a sealing member of resilient material having a circumference, said sealing member being fitted within said cylindrical portion of said cap with a peripherial portion thereof adjacent to said circumference of the sealing member positioned over said pluralities of ribs extending from said interior surface of said cap to prevent turning of the cap relative to the sealing member during closing and opening of a container so that the sealing member may be sealingly fit over a mouth of a container with said peripherial portion of the sealing member over an end of a wall portion of a container encircling a mouth thereof; and wherein said sealing member is of substantially frustoconical shape, flares outwardly from a central portion thereof and has a central, substantially cylindrical, longitudinally extending sleeve, said stud being fitted within said sleeve;

whereby the closure can be placed on and removed from a container by application of high removal torques without the sealing member turning relative to the cap.

4. The closure according to claim 3, wherein each of said ribs is defined by a respective inclined surface extending from said interior surface of said top and a respective further surface extending from said interior surface of said top and substantially perpendicular thereto, each of said respective further surfaces intersecting with one of said respective inclined surfaces.

5. The closure according to claim 4, wherein said ribs are radially extending on the interior surface in vicinity of intersection between the interior surface and the cylindrical portion, said radially extending ribs being substantially equally spaced from adjacent ones thereof.

6. A closure for a container having a mouth defined by a container wall portion encircling the mouth, the closure comprising in combination:

a cap having an open ended cylindrical portion with means thereon for tightening the cap upon a container, an aperture-free top portion provided with an interior circular surface having four quadrants and closing one end of the cap and respective pluralities of ribs extending from the interior surface in each of the quadrants in vicinity of intersection between the interior surface and the cylindrical portion and an internal stud of substantially noncircular cross-section extending from the interior surface and centrally located thereon; and a sealing member of resilient material having a circumference, said sealing member being fitted within said cylindrical portion of said cap with a peripherial portion thereof adjacent to said circumference of the sealing member positioned over said pluralities of ribs extending from said interior surface of said cap to prevent turning of the cap relative to the sealing member during closing and opening of a container so that the sealing member may be sealingly fit over a mouth of a container with said peripherial portion of the sealing member over an end of a wall portion of a container encircling a mouth thereof;

wherein said cap is provided with an internal stud of noncircular cross-section; and wherein said sealing member is of substantially frustoconical shape, flares outwardly from a central portion thereof and has a central, longitudinally extending sleeve having a noncircular cross-section corresponding to the cross-section of the stud, said stud being fitted within said sleeve;

whereby the closure can be placed on and removed from a container by application of high removal torques without the sealing member turning relative to the cap.

7. The closue according to claim 6, wherein said ribs are radially extending on the interior surface in vicinity of intersection between the interior surface and the cylindrical portion, said radially extending ribs being substantially equal spaced from adjacent ones thereof.

* * * * *

UNITED STATES PATENT AND TRADEMARK OFFICE

CERTIFICATE OF CORRECTION

PATENT NO. : 4,744,481

DATED : May 17, 1988

INVENTOR(S) : Robert L. Morgan, Jr.

It is certified that error appears in the above-identified patent and that said Letters Patent is hereby corrected as shown below:

In the Title Page, the date filed should be changed from "April 6, 1987" to -- May 6, 1987 -- .

Column 5, line 64, "an" should read -- any -- .

Column 10, line 49, Claim 2, "conicals" should read -- conical -- .

Signed and Sealed this

Eleventh Day of July, 1989

*Attest:*

*Attesting Officer*

DONALD J. QUIGG

*Commissioner of Patents and Trademarks*